US006875548B2

(12) United States Patent
Tong et al.

(10) Patent No.: US 6,875,548 B2
(45) Date of Patent: Apr. 5, 2005

(54) PHOTOCONDUCTIVE IMAGING MEMBERS

(75) Inventors: Yuhua Tong, Webster, NY (US); Timothy J. Fuller, Pittsford, NY (US); John F. Yanus, Webster, NY (US); Dale S. Renfer, Webster, NY (US); Markus R. Silvestri, Fairport, NY (US); Cindy C. Chen, Rochester, NY (US); Dennis J. Prosser, Walworth, NY (US); Susan M. VanDusen, Williamson, NY (US); Lanhui Zhang, Penfield, NY (US); Sean X. Pan, Webster, NY (US)

(73) Assignee: Xerox Corporation, Stamford, CT (US)

( * ) Notice: Subject to any disclaimer, the term of this patent is extended or adjusted under 35 U.S.C. 154(b) by 103 days.

(21) Appl. No.: 10/369,798

(22) Filed: Feb. 19, 2003

(65) Prior Publication Data

US 2004/0175637 A1 Sep. 9, 2004

(51) Int. Cl.[7] ..... G03G 5/047

(52) U.S. Cl. ..... 430/58.2; 430/58.8; 430/59.4; 430/60; 399/297

(58) Field of Search ..... 430/58.2, 58.8, 430/59.4, 60, 59.5; 399/297

(56) References Cited

U.S. PATENT DOCUMENTS

| | | | | | |
|---|---|---|---|---|---|
| 4,265,990 | A | | 5/1981 | Stolka et al. | 430/59 |
| 5,069,993 | A | * | 12/1991 | Robinette et al. | 430/58.8 |
| 5,473,064 | A | | 12/1995 | Mayo et al. | 540/141 |
| 5,482,811 | A | | 1/1996 | Keoshkerian et al. | 430/135 |
| 5,493,016 | A | | 2/1996 | Burt et al. | 540/139 |
| 5,645,965 | A | | 7/1997 | Duff et al. | 430/59 |
| 5,840,816 | A | * | 11/1998 | Kobayashi et al. | 526/169 |
| 5,871,877 | A | | 2/1999 | Ong et al. | 430/59 |
| 5,874,193 | A | | 2/1999 | Liu et al. | 430/59 |
| 6,117,603 | A | * | 9/2000 | Yu et al. | 430/66 |
| 6,287,737 | B1 | | 9/2001 | Ong et al. | 430/58.8 |

* cited by examiner

*Primary Examiner*—John L Goodrow
(74) *Attorney, Agent, or Firm*—E. D. Palazzo

(57) ABSTRACT

A photoconductive imaging member including an optional supporting substrate, a photogenerating layer, and a charge transport layer, and wherein said layer includes a charge transport component and a polysiloxane.

37 Claims, No Drawings

PHOTOCONDUCTIVE IMAGING MEMBERS

RELATED PATENTS

Illustrated in U.S. Pat. No. 5,645,965, the disclosure of which is totally incorporated herein by reference, are photoconductive imaging members with perylenes and a number of charge transports, such as amines.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water.

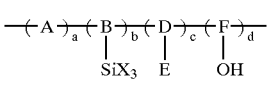

(I)

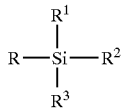

(II)

wherein A, B, D, and F represent the segments of the polymer backbone; E is an electron transporting moiety; X is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,874,193, the disclosure of which is totally incorporated herein by reference, are photoconductive imaging members with a hole blocking layer comprised of a crosslinked polymer derived from crosslinking an alkoxysilyl-functionalized polymer bearing an electron transporting moiety. In U.S. Pat. No. 5,871,877, the disclosure of which is totally incorporated herein by reference, there are illustrated multilayered imaging members with a solvent resistant hole blocking layer comprised of a crosslinked electron transport polymer derived from crosslinking a thermally crosslinkable alkoxysilyl, acyloxysilyl or halosilyl-functionalized electron transport polymer with an alkoxysilyl, acyloxysilyl or halosilyl compound, such as alkyltrialkoxysilane, alkyltrihalosilane, alkylacyloxysilane, aminoalkyltrialkoxysilane, and the like, in contact with a supporting substrate and situated between the supporting substrate and a photogenerating layer, and which layer may be comprised of the photogenerating pigments of U.S. Pat. No. 5,482,811, the disclosure of which is totally incorporated herein by reference.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a perylene photogenerating layer, which can be comprised of a mixture of bisbenzimidazo(2,1-a-1',2'-b)anthra(2,1,9-def:6,5,10-d'e'f')diisoquinoline-6,21-dione and bisbenzimidazo(2,1-a:2'1'-a)anthra(2, 1,9-def:6,5, 10-d'e'f')diisoquinoline-10,21-dione, reference U.S. Pat. No. 4,587,189, the disclosure of which is totally incorporated herein by reference.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindoline in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Further, illustrated in U.S. Pat. No. 5,645,965, the disclosure of which is totally incorporated herein by reference, are symmetrical perylene photoconductive members.

The appropriate components and processes of the above patents may be selected for the present invention in embodiments thereof.

BACKGROUND

This invention is generally directed to imaging members, and more specifically, the present invention is directed to multilayered photoconductive imaging members wherein the charge transport layer thereof contains a crosslinkable polysiloxane, and wherein there are enabled imaging members with excellent physical properties, such as reduced wear rates, and excellent electrical characteristics, such as acceptable surface, and photoelectrical properties, and no or minimal scanning cycle up voltage. More specifically, the present invention in embodiments is directed to a photoconductive imaging member containing a charge transport layer comprised of charge, especially hole transport components and a (meth)acrylate ended polysiloxane of, for example, the following formula

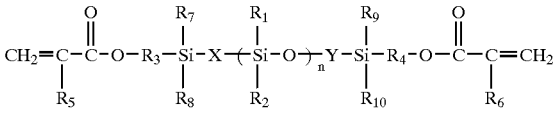

wherein n represents the number of repeating segments, for example n can be a number or fraction thereof of from about 2 to about 10,000, more specifically from about 100 to about 7,000, and yet more specifically from about 1,000 to about 5,000; X and Y are independently selected from the group comprising oxygen and sulfur; $R_1$ to $R_4$ and $R_7$ to $R_{10}$ are independently selected from the group comprising alkyl, substituted alkyl, aryl, and substituted aryl, with the substituents being, for example, halide, alkoxy, aryloxy, and amino; and $R_5$ and $R_6$ are independently selected from the group consisting of hydrogen and alkyl, such as methyl.

In embodiments the (meth)acrylate end groups are polymerizable in the presence of free radical initiators, or under free radical polymerization conditions, and wherein the crosslinking density of the charge transport mixture can be preselected and tuned based on the content of the (meth) acrylate ended polysiloxanes. Also, in embodiments the crosslinked an be derived, for example, from crosslinking a trialkoxysilyl-functioned hydroxyalkyl acrylate or trialkoxysilyl-functionalized hydroxyalkyl alkylacrylate with an aminoalkylalkoxysilane, such as gamma-aminoalkyltrialkyloxysilane, reference for example the following

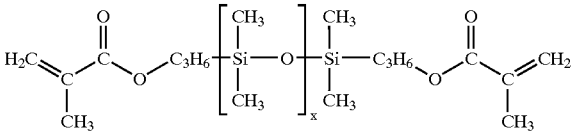

Methacryloxy Terminated Polysiloxanes

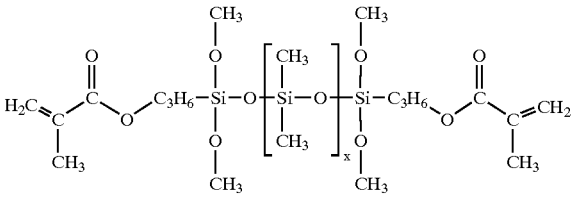

Methacryloxy/methoxy Terminated Polysiloxanes

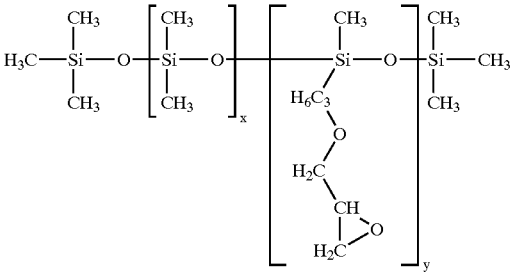

Epoxy-alkyl Blocked Polysiloxanes

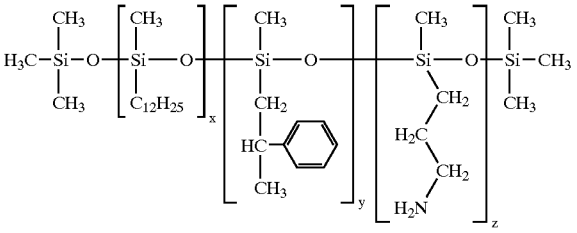

Amine-alkyl Blocked Polysiloxanes

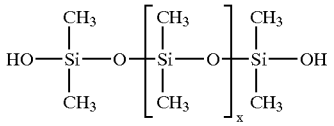

Hydroxyl End-Blocked Polysiloxanes

The imaging members of the present invention in embodiments exhibit excellent cyclic/environmental stability, and substantially no adverse changes in their performance over extended time periods, and excellent resistance to mechanical abrasion, and therefore extended photoreceptor life. The aforementioned photoresponsive, or photoconductive imaging members can be positively charged or negatively charged when the photogenerating layer is situated between the charge transport layer and the substrate.

Processes of imaging, especially xerographic imaging and printing, including digital, are also encompassed by the present invention. More specifically, the layered photoconductive imaging members of the present invention can be selected for a number of different known imaging and printing processes including, for example, color processes, digital imaging process, digital printers, PC printers, and electrophotographic imaging processes, especially xerographic imaging and printing processes wherein charged latent images are rendered visible with toner compositions of an appropriate charge polarity. The imaging members of the present invention are in embodiments sensitive in the wavelength region of, for example, from about 500 to about 900 nanometers, and more specifically, from about 650 to about 850 nanometers, thus diode lasers can be selected as the light source. Moreover, the imaging members of the present invention in embodiments can be selected for color xerographic systems.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport, can be selected for the imaging members of the present invention in embodiments thereof.

SUMMARY

It is a feature of the present invention to provide imaging members with many of the advantages illustrated herein, such as for example, extended, serviceable life, and excellent wear characteristics.

Another feature of the present invention relates to the provision of an imaging member with excellent photoelectronic properties, such as excellent photoinduced discharge performance, low discharge residual voltage and rapid transit charge carrier mobility.

A further feature of the present invention is the provision of improved layered photoresponsive imaging members which are responsive to near infrared radiation exposure.

It is yet another feature of the present invention to provide charge transport mixtures for layered photoresponsive imaging members.

In a further feature of the present invention there are provided imaging members containing crosslinked compatible polysiloxane additives in the charge transport layer.

Aspects of the present invention relate to a photoconductive imaging member comprised of an optional supporting substrate, a photogenerating layer, and a charge transport layer comprised of charge transport components and a polysiloxane, and more specifically, a methacrylate ended polysiloxane; or, for example, a crosslinked hybrid composite polysiloxane-silica generated from the reaction of a silyl functionalized hydroxyalkyl polymer of Formula (I) with an organosilane of Formula (II)

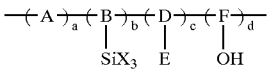

(I)

-continued

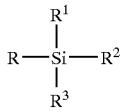

(II)

wherein A, B, D, and F represent the segments of the polymer backbone; E is a charge such as a hole transporting moiety; X is, for example, selected from the group consisting of halide, cyano, alkoxy, acyloxy, and aryloxy; a, b, c, and d each represent mole fractions of the repeating monomer units such that the sum of a+b+c+d is equal to about 1; R is, for example, alkyl, substituted alkyl, aryl, or substituted aryl, and $R^1$, $R^2$, and $R^3$ are independently selected, for example, from the group consisting of alkyl, aryl, alkoxy, aryloxy, acyloxy, halide, cyano, and amino, subject to the provision that, for example, two of $R^1$, $R^2$, and $R^3$ are each independently, for example, selected from the group consisting of alkoxy, aryloxy, acyloxy, and halide; a photoconductive imaging member comprised in sequence of a supporting substrate, a photogenerating layer, and a charge transport layer comprised of hole transport molecules and a crosslinked polysiloxane; a photoconductive imaging member comprised of a supporting substrate, an optional hole blocking layer thereover, a photogenerating layer, and the charge transport layer mixture illustrated herein; a photoconductive imaging member comprised in the following sequence of a supporting substrate, an adhesive layer, a photogenerating layer, and the charge transport layer mixture illustrated herein; a photoconductive imaging member wherein an adhesive layer included is comprised of a polyester with an $M_w$ of from about 15,000 to about 125,000, and more specifically, about 35,000, and an $M_n$ of from about 10,000 to about 75,000, and more specifically, about 14,000; a photoconductive imaging member wherein the supporting substrate is comprised of a conductive metal substrate; a photoconductive imaging member wherein the conductive substrate is aluminum, aluminized or titanized polyethylene terephthalate belt (MYLAR); a photoconductive imaging member wherein the photogenerating layer is of a thickness of from about 0.05 to about 10 microns; a photoconductive imaging member wherein the transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the aryl amines are of the formula

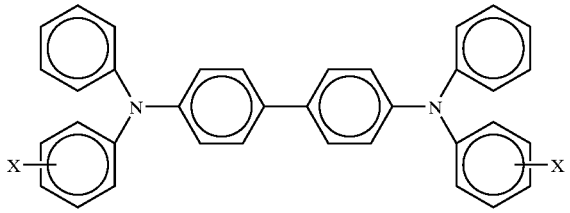

wherein X is selected from the group consisting of alkyl and halogen, and wherein the aryl amine may be dispersed in a resinous binder; a photoconductive imaging member wherein the arylamine alkyl contains from about 1 to about 10 carbon atoms; a photoconductive imaging member wherein the arylamine alkyl contains from 1 to about 5 carbon atoms; a photoconductive imaging member wherein the arylamine alkyl is methyl, wherein halogen is chloride, and wherein the resinous binder is selected from the group consisting of polycarbonates and polystyrenes; a photoconductive imaging member wherein the aryl amine is N,N'-diphenyl -N,N-bis(3-methylphenyl)-1,1'-biphenyl4,4'-diamine; a photoconductive imaging member further including an adhesive layer of a polyester with an $M_w$ of preferably about 70,000, and an $M_n$ of from about 25,000 to about 50,000, and preferably about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member, developing the latent image, and transferring the developed electrostatic image to a suitable substrate; a photoconductive imaging member comprised of an optional supporting substrate, a photogenerating layer, and a charge transport layer comprised of a charge transport component and a polysiloxane; an imaging member wherein the polysiloxane is a crosslinkable polysiloxane; an imaging member wherein the polysiloxane is of the formula

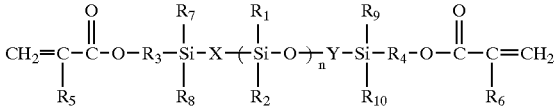

wherein n represents the number of segments, X and Y are independently selected from the group consisting of oxygen and sulfur, $R_1$ to $R_4$ and $R_7$ to $R_{10}$ are independently selected from consisting of alkyl; and $R_5$ and $R_6$ are independently selected from consisting of hydrogen and alkyl; an imaging member wherein the polysiloxane possesses a weight average molecular weight $M_w$ of from about 200 to about 200,000; an imaging wherein the polysiloxane possesses an $M_n$ of from about 100 to about 100,000; an imaging member wherein the polysiloxane possesses an $M_w$ of from about 2,000 to 500,000, and a number average molecular weight $M_n$ of from about 1,000 to about 25,000; an imaging member wherein the polysiloxane possesses a crosslinking value of from about 50 percent to about 100 percent gel as measured by FT-IR; an imaging member wherein the polysiloxane possesses a crosslinking value of from about 80 percent to about 100 percent gel; an imaging member wherein the polysiloxane is selected from the group comprised of methacryloxypropylsilsesquioxane-dimethylsiloxane copolymer, (methylacryloxypropyl) methylsiloxane-dimethylsiloxane copolymer, polydimethylsiloxane methacryloxypropyl terminated, polydimethylsiloxane acryloxyl terminated, diphenylsiloxane-dimethylsiloxane copolymer methacryloxypropyl terminated, phenylmethylsiloxane-dilphenylsiloxane copolymer methacryloxypropyl terminated and phenylmethylsiloxane-dimethylsiloxane copolymer methacryloxypropyl terminated (methylacryloxypropyl)methylsiloxane-dimethylsiloxane copolymer and phenylmethylsiloxane-dilphenylsiloxane copolymer methacryloxypropyl terminated; an imaging member wherein the polysiloxane is a (methylacryloxypropyl)methylsiloxane-dimethylsiloxane copolymer with a $M_w$ of from about 500 to about 5,000 and a crosslinking value of from about 80 to about 100 percent; an imaging member wherein the polysiloxane is present in an amount of from about 0.1 to about 50 weight percent based on the weight percent of charge transport components and the polysiloxane; an imaging member wherein the polysiloxane is present in an amount of from about 0.5 to about 25 weight percent; an imaging member wherein the polysiloxane is present in an amount of from about 1 to about 15 weight percent; an imaging member wherein the polysiloxane is present in an amount of from about 0.1 to about 50 weight percent, the charge transport component is present in an amount of from about 10 of about 75 weight percent, and wherein the total thereof is about 100 percent; an imaging member wherein the polysiloxane n, the number of repeating segments, is from about 1 to about 5,000; an imaging member wherein n, the number of repeating segments, is from about 10 to about 200; an imaging member wherein n, the number of repeating segments, is about from 1,000 to about 4,000; an imaging member wherein the polysiloxane and the charge transport component is crosslinked by a free radical reaction; an imaging member comprised in the following sequence of a supporting substrate, an adhesive layer, a photogenerating layer, and a charge transport layer mixture illustrated herein; an imaging member wherein the adhesive layer is comprised of a polyester with an optional $M_w$ of from about 50,000 to about 90,000, and an optional $M_n$ of about 25,000 to about 45,000; an imaging member wherein the supporting substrate is comprised of a conductive substrate; an imaging member wherein the conductive substrate is aluminum, aluminized polyethylene terephthalate or titanized polyethylene terephthalate; an imaging member wherein the photogenerator layer is of a thickness of from about 0.05 to about 10 microns, and the transport layer is of a thickness of from about 10 to about 50 microns; an imaging member wherein the photogenerating layer is comprised of photogenerating pigments dispersed in a resinous binder in an amount of from about 5 percent by weight to about 95 percent by weight, and optionally dispersed in a resinous binder selected from the group consisting of polyesters, polyvinyl butyrals, polycarbonates, polystyrene-b-polyvinyl pyridine, and polyvinyl formals; an imaging member wherein the charge transport layer comprises aryl amine molecules of the formula

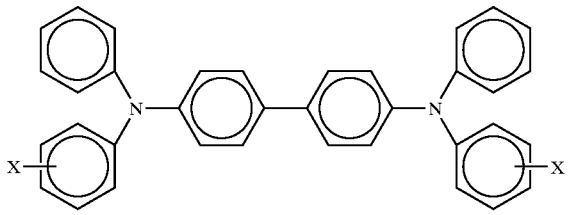

wherein X is selected from the group consisting of alkyl and halogen, and wherein the aryl amine is optionally dispersed in a highly insulating and transparent resinous binder; an imaging member wherein the aryl amine is N,N'-diphenyl-N,N-bis(3-methyl phenyl)-1,1'-biphenyl-4,4'-diamine; an imaging member wherein the photogenerating layer is comprised of metal phthalocyanines, metal free phthalocyanines, or a hydroxygallium phthalocyanine; a method of imaging which comprises generating an image on the imaging member illustrated herein, developing the latent image, and optionally transferring the image to a substrate; a photoconductive imaging member comprised in sequence of a supporting substrate, a photogenerating layer, and a charge transport layer, and which layer is comprised of a charge transport component and a methacrylate polysiloxane of the formula

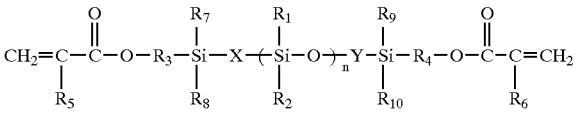

wherein n is number or fraction thereof of from about 2 to about 10,000; X and Y are independently selected from the group comprised of oxygen and sulfur; $R_1$ to $R_4$ and $R_7$ to $R_{10}$ are independently selected from the group comprised of alkyl, substituted alkyl, aryl, and substituted aryl, with the substituent being, for example, halide, alkoxy, aryloxy, or amino; and $R_5$ and $R_6$ are independently selected from the group comprised of hydrogen and alkyl; an imaging member wherein the polysiloxane possesses an $M_n$ of from about 20,000 to about 100,000, and an Mn of from about 10,000 to about 50,000; a xerographic apparatus comprising a charging component, the photoconductive component illustrated herein, a development component, a transfer component, and an optional cleaning component; an imaging member wherein the $M^w$ of the polysiloxane is from about 20,000 to about 100,000, and the $M_n$ is from about 10,000 to about 50,000; an imaging member wherein the polysiloxane alkyl contains from about 1 to about 25 carbon atoms, and aryl contains from about 6 to about 30 carbon atoms; an imaging member wherein the polysiloxane alkyl and aryl is substituted with halide, alkoxy, or amino; an imaging member wherein the polysiloxane is crosslinked; an imaging member wherein the polysiloxane X is oxygen; and an imaging member wherein the polysiloxane Y is oxygen.

The substrate layers selected for the imaging members of the present invention can be opaque, substantially transparent, or the like, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials as MAKROLON®.

The thickness of the substrate layer depends on many factors, including economical considerations, thus this layer may be of substantial thickness, for example over 3,000 microns, or of a minimum thickness providing there are no adverse effects on the member. In one embodiment, the thickness of this layer is from about 75 microns to about 300 microns.

The photogenerating layer can contain known photogenerating pigments, such as metal phthalocyanines, metal free phthalocyanines, hydroxygallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components, such as selenium, especially trigonal selenium, selenium alloys, and the like. The photogenerating pigment can be dispersed in a resin binder similar to the resin binder selected for the charge transport layer, or alternatively no resin binder can be present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 30 microns, and more specifically, from about 0.25 micron to about 2 microns when, for example, the photogenerator compositions are present in an amount of from about 30 to about 75 percent by volume. The maximum thickness of the layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, die slot, gravure, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. at, for example, about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer is from about 0 to about 95 percent by weight, and preferably from about 25 to about 60 percent by weight of the photogenerator layer.

As optional adhesive layer usually in contact with the supporting substrate layer, there can be selected various known substances inclusive of polyesters, polyamides, poly (vinyl butyral), poly(vinyl alcohol), polyurethane and polyacrylonitrile. This layer is, for example, of a thickness of from about 0.001 micron to about 3 microns. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention desirable electrical and optical properties.

Aryl amines selected for the charge transporting layers, which generally is of a thickness of from about 5 microns to about 75 microns, and preferably of a thickness of from about 10 microns to about 35 microns, include molecules of the following formula

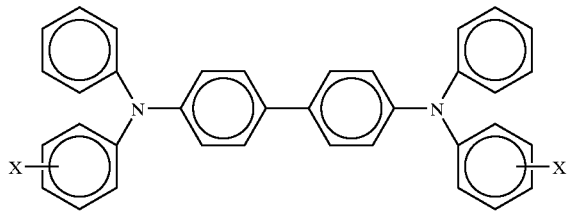

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of polymer binder materials selected for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders include, for example, polycarbonate resins possessing a molecular weight $M_w$ of from about 20,000 to about 100,000 and more specifically with a molecular weight of from about 50,000 to about 95,000. Generally, the transport layer contains from about 10 to about 75 percent by weight of the charge transport material, and preferably from about 35 percent to about 50 percent of this material.

Examples of the methacrylated polysiloxanes are as illustrated herein, and more specifically, include methacryloxy propyl dimethoxy silyl end blocked dimethyl silicone fluids; methacryloxy propyl end blocked dimethyl silicone fluid (obtained from Genesee Polymers Corporation); (methacryloxypropyl)methylsiloxane-dimethylsiloxane copolymers; acryloxypropyl)methylsiloxane-dimethylsiloxane copolymers; methacryloxypropyl T-structure siloxanes (obtained from Gelest Inc), and the like. Methacrylated polysiloxanes are crosslinkable with active) free radical sources, and wherein the crosslinking density is from about 50 percent to a out 100 percent as measured by FT-IR. These and other useful polymers possess, for example, a weight average, $M_w$, molecular weight of from about 200 to about 200,000, and more specifically, from about 500 to about 50,000. Generally, the transport layer contains from about 0.1 to about 50 percent by weight of the methacrylated polysiloxanes, and more specifically, from about 1 percent to about 20 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate further specific embodiments of the present invention. These Examples are intended to be illustrative only and are not intended to limit the scope of the present invention. Also, parts and percentages are by weight unless otherwise indicated. Comparative Examples and data are also provided.

EXAMPLE I

On a 75 micron thick titanized MYLAR® substrate was coated by draw bar techniques a barrier layer formed from hydrolyzed gamma aminopropyltriethoxysilane having a thickness of 0.005 micron. The barrier layer coating was prepared by mixing 3-aminopropyltriethoxysilane with ethanol in a 1:50 volume ratio. The coating was allowed to dry for 5 minutes at room temperature, about 22° C. to about 25° C., followed by curing for 10 minutes at 110° C. in a forced air oven. On top of the blocking layer was coated a 0.05 micron thick adhesive layer prepared from a solution of 2 weight percent of an E.I. DuPont 49,000 polyester in dichloromethane. A 0.2 micron photogenerating layer was then coated on top of the adhesive layer from a dispersion of hydroxy gallium phthalocyanine Type V (0.46 gram) and a polystyrene-polyvinylpyridine block copolymer binder (0.48 gram) in 20 grams of toluene, followed by drying at 100° C. for 10 minutes. Subsequently, a 25 micron hole transport (CTL) was coated on top of the photogenerating layer from a solution of N,N'-diphenyl-N,N-bis(3-methyl phenyl)-1,1'-biphenyl-4,4-diamine (1.2 grams), polycarbonate resin [poly(4,4'-isopropylidene-diphenylene carbonate)] available as MAKROLON® from Farbenfabricken Bayer A. G. (1 gram), the free radical initiator 2,2'-azobisisobutyronitrile (2 milligrams), 0.2 gram of methacryloxy propyl end blocked dimethyl silicone copolymer, $M_w$ 40,000 and $M_n$ 31,000, which silicone copolymer is obtainable from Genesee Polymers Inc., and methylene chloride (13.5 grams), using a 6 mil gap bar by hand coating. The resulting device or photoconductive member was dried and cured at 110° C. for 30 minutes. After fried (heating), the FT-IR measured an about 95 percent crosslinking for the silicone copolymer.

EXAMPLE II

A control device was prepared in a similar manner to that of Example I and without the methacryloxy propyl end blocked dimethyl polysiloxane contained in the charge transport mixture.

EXAMPLE III

Flexible photoreceptor sheets prepared as described in Examples I and II were tested for their xerographic sensitivity and cyclic stability. Each photoreceptor sheet to be evaluated was mounted on a cylindrical aluminum drum which was subsequently mounted in a xerographic scanner. Xerographic scanners were known and were comprised of a means to rotate the sample while it was electrically charged and discharged. The charge on the sample was monitored through the use of electrostatic probes placed at precise positions around the circumference of the aluminum drum supporting the samples. The sample of Example I above was charged to a negative potential of 800 volts. As the drum rotated the initial charging potential was measured by a voltage probe 1. The sample was then exposed to monochromatic radiation of known intensity and the surface potential measured by voltage probes 2 and 3. Finally, the sample was exposed to an erase lamp emitting red light and any residual potential was measured by a voltage probe 4. The PIDCs (photoinduced discharge curves) were obtained by plotting the potentials at voltage probes 2 and 3 as a function of the light energy. The residual voltage was compared after 10,000 charge/discharge cycles. The Example I sample showed a 35 volt increase in residual voltage, which translates into higher quality images with substantially no background deposits while the Example II sample showed a 55 volt increase which translated into lower quality images with background deposits.

EXAMPLE IV

Charge carrier mobilities were measured as follows for the two members of Example I and II. A vacuum chamber was employed to deposit a semitransparent gold electrode layer of about 15 nanometers in thickness on top of each device. The resulting sandwich device was connected to an electrical circuit containing a power supply and a current measuring resistance. The transit time of the charge carriers was determined by the time of flight technique. This was accomplished by biasing the gold electrode to a negative potential and exposing the device to a brief flash of red light. Holes photogenerated in the generating layer of the hydroxy gallium phthalocyanine layers were injected into and transited through the transport layer. The current due to the transit of a sheet of holes was time resolved and displayed on an oscilloscope. The current pulse displayed on the oscilloscope comprised a curve having flat segment followed by a rapid decrease. The flat segment was due to the transit of the sheet of holes through the transport layer. The rapid drop of current signaled the arrival of the holes at the gold electrode. From the transit time, the velocity of the carriers was calculated by the relationship velocity=transport layer thickness/transit time.

The hole mobility is related to the velocity by the relationship velocity=(mobility)×(electric field).

The mobility of the two devices at an applied electric field of $1\times10^5$ V/centimeter was $1.7\times10^{-5}$ $cm^2$/V second for the device of Example I compared with $9\times10^{-6}$ $cm^2$/V second for the device of Example II, which means for example, that the mobility of the carries for device I was more rapid by $8\times10^{-6}$ $cm^2$/V second, a 90 percent increase as compared to device II. In general, the rapid mobility of carriers enabled, for example, higher image quality and a rapid rate of machine operation for a xerographic machine that incorporated the imaging member.

EXAMPLE V

The contact angles of water on the above generated device surfaces were measured at ambient temperature, about 23° C., using the known Contact Angle System OCA (Dataphysics Instruments GmbH, model OCA15). Deionized water was used as a liquid phase. At least ten measurements were performed and their average was reported for each device. The device of Example I had a contact angle of 102.3° compared with a contact angle of 90.5° for the device of Example II. The surface energies calculated from the equation $$2\cdot\left(\frac{\gamma_{sv}}{\gamma_{lv}}\right)^{1/2}\cdot\exp[-\beta(\gamma_{lv}-\gamma_{sv})^2]=1+\cos\theta$$

were 21.7 erg.$cm^{-2}$ for the device of Example I and 28.9 erg.$cm^{-2}$ for the device of Example II, respectively, where $\gamma_{sv}$ and $\gamma_{1v}$ are the surface energies of the solid surfaces and liquid surfaces, respectively, θ was the contact angle, and β was a constant. Generally, lower surface energy enabled easier and more efficient toner transfer and cleaning.

While particular embodiments have been described, alternatives, modifications, variations, improvements, and substantial equivalents that are or may be presently unforeseen may arise to applicants or other skilled in the art. Accordingly, the appended claims as filed and as they may be amended are intended to embrace all such alternatives, modifications variations, improvements, and substantial equivalents.

What is claimed is:

1. A photoconductive imaging member comprised of an optional supporting substrate, a photogenerating layer, and a charge transport layer, and wherein said charge transport layer is comprised of a charge transport component and a cross linkable polysiloxane present in an amount of from about 0.1 to about 50 weight percent.

2. An imaging member in accordance with claim 1, wherein said polysiloxane is of the formula

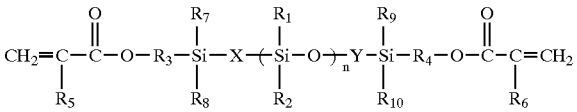

wherein n represents the number of segments from 1 to about 10,000, X and Y are independently selected from the group consisting of oxygen and sulfur, $R_1$ to $R_4$ and $R_7$ to $R_{10}$ are independently selected from the group comprised of alkyl and aryl; and $R_5$ and $R_6$ are independently selected from the group comprised of hydrogen and alkyl.

3. An imaging member in accordance with claim 2 wherein said polysiloxane possesses a weight average molecular weight $M_w$ of from about 200 to about 200,000.

4. An imaging member in accordance with claim 2 wherein said polysiloxane possesses an $M_n$ of from about 100 to about 100,000.

5. An imaging member in accordance with claim 2 wherein said polysiloxane possesses an $M_w$ of from about 2,000 to 500,000, and a number average molecular weight $M_n$ of from about 1,000 to about 25,000.

6. An imaging member in accordance with claim 2 wherein said polysiloxane possesses a crosslinking value of from about 50 percent to about 100 percent gel as measured by FT-IR.

7. An imaging member in accordance with claim 6 wherein said polysiloxane possesses a crosslinking value of from about 80 percent to about 100 percent gel.

8. An imaging member in accordance with claim 1 wherein said polysiloxane is selected from the group comprised of methacryloxypropylsilsesquioxane-dimethylsiloxane copolymer, (methylacryloxypropyl) methylsiloxane-dimethylsiloxane copolymer, polydimethylsiloxane methacryloxypropyl terminated, polydimethylsiloxane acryloxyl terminated, diphenylsiloxane-dimethylsiloxane copolymer methacryloxypropyl terminated, phenylmethylsiloxane-dilphenylsiloxane copolymer methacryloxypropyl terminated and phenylmethylsiloxane-dimethylsiloxane copolymer methacryloxypropyl terminated, (methylacryloxypropyl)methylsiloxane-dimethylsiloxane copolymer and phenylmethylsiloxane-dilphenylsiloxane copolymer methacryloxypropyl terminated.

9. An imaging member in accordance with claim 1 wherein said polysiloxane is a (methylacryloxypropyl) methylsiloxane-dimethylsiloxane copolymer with an $M_w$ of from about 500 to about 5,000 and a crosslinking value of from about 80 to about 100 percent.

10. An imaging member in accordance with claim 2 wherein said polysiloxane is present in an amount of from about 0.5 to about 25 weight percent.

11. An imaging member in accordance with claim 2 wherein said polysiloxane is present in an amount of from about 1 to about 15 weight percent.

12. An imaging member in accordance with claim 2 wherein said polysiloxane is present in an amount of from about 0.1 to about 50 weight percent, said charge transport component is present in an amount of from about 10 of about 75 weight percent, and wherein the total thereof is about 100 percent.

13. An imaging member in accordance with claim 2 wherein n, the number of repeating segments, is from about 1 to about 5,000.

14. An imaging member in accordance with claim 2 wherein n, the number of repeating segments, is from about 10 to about 200.

15. An imaging member in accordance with claim 2 wherein n, the number of repeating segments, is about from 1,000 to about 4,000.

16. An imaging member in accordance with claim 1 wherein said polysiloxane and said charge transport component are crosslinked by a free radical reaction.

17. An imaging member in accordance with claim 1 comprised in the following sequence of a supporting substrate, an adhesive layer, a photogenerating layer, and said charge transport layer.

18. An imaging member in accordance with claim 17 wherein the adhesive layer is comprised of a polyester with an optional $M_w$ of from about 50,000 to about 90,000, and an optional $M_n$ of about 25,000 to about 45,000.

19. An imaging member in accordance with claim 1 wherein the supporting substrate is comprised of a conductive substrate.

20. An imaging member in accordance with claim 19 wherein the conductive substrate is aluminum, aluminized polyethylene terephthalate or titanized polyethylene terephthalate.

21. An imaging member in accordance with claim 1 wherein said photogenerator layer is of a thickness of from about 0.05 to about 10 microns, and said transport layer is of a thickness of from about 10 to about 50 microns.

22. An imaging member in accordance with claim 1 wherein the photogenerating layer is comprised of photogenerating pigments dispersed in a resinous binder, and which pigments are present in an amount of from about 5 percent by weight to about 95 percent by weight, and optionally dispersed in a resinous binder selected from the group consisting of polyesters, polyvinyl butyrals, polycarbonates, polystyrene-b-polyvinyl pyridine, and polyvinyl formals.

23. An imaging member in accordance with claim 1 wherein said charge transport layer comprises aryl amine molecules of the formula

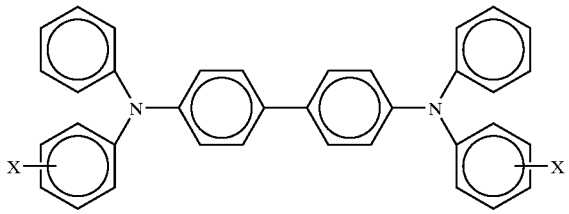

wherein X is selected from the group consisting of alkyl and halogen.

24. An imaging member in accordance with claim 23 wherein the aryl amine is N,N'-diphenyl-N,N-bis(3-methyl phenyl)-1,1'-biphenyl-4,4'-diamine.

25. An imaging member in accordance with claim 1 wherein the photogenerating layer is comprised of metal phthalocyanines, metal free phthalocyanines, or a hydroxygallium phthalocyanine.

26. A method of imaging which comprises generating an image on the imaging member of claim 1, developing the latent image, and transferring the image to a substrate.

27. A photoconductive imaging member comprised in sequence of a supporting substrate, a photogenerating layer, and a charge transport layer, comprised of a charge transport component and a methacrylate polysiloxane of the formula

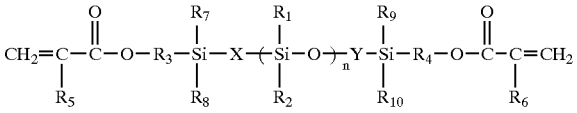

wherein n is a number or fraction thereof of from about 2 to about 10,000 present in an amount of from about 0.1 to about 50 percent; X and Y are independently selected from the group comprised of oxygen and sulfur; $R_1$ to $R_4$ and $R_7$ to $R_{10}$ are independently selected from the group comprised of alkyl, substituted alkyl, aryl, and substituted aryl, with the substituent being halide, alkoxy, aryloxy, or amino; and $R_5$ and $R_6$ are independently selected from the group comprised of hydrogen and alkyl.

28. An imaging member in accordance with claim 27 wherein said polysiloxane possesses an $M_w$ of from about 20,000 to about 100,000, and an $M_n$ of from about 10,000 to about 50,000.

29. A xerographic apparatus comprising a charging component, the photoconductive component of claim 1, a development component, a transfer component, and an optional cleaning component.

30. An imaging member In accordance with claim 8 wherein the $M_w$ of said polysiloxane is from about 20,000 to about 100,000, and the $M_n$ is from about 10,000 to about 50,000.

31. An imaging member in accordance with claim 2 wherein said alkyl contains from about 1 to about 25 carbon atoms, and said aryl contains from about 6 to about 30 carbon atoms.

32. An imaging member in accordance with claim 2 wherein said alkyl and said aryl are substituted with halide, alkoxy, or amino.

33. An imaging member in accordance with claim 1 wherein said polysiloxane is crosslinked.

34. An imaging member in accordance with claim 2 wherein X is oxygen.

35. An imaging member in accordance with claim 2 wherein Y is oxygen.

36. A photoconductive member comprised of a supporting substrate, a photogenerating layer, and a charge transport layer, and wherein said charge transport layer is comprised of a charge transport component and a polysiloxane present in an amount of from about 0.1 to about 50 weight percent; and wherein said polysiloxanes is of the formula

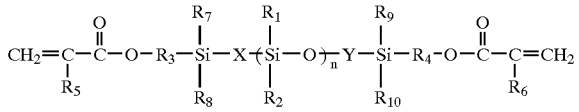

wherein n represents the number of segments from 1 to about 10,000 X and Y are independently selected from the group consisting of oxygen and sulfur, $R_1$ to $R_4$ and $R_7$ to $R_{10}$ are independently selected from the group comprised of alkyl and aryl; and $R_5$ and $R_6$ are independently selected from the group comprised of hydrogen and alkyl.

37. A photoconductive member in accordance with claim 36 wherein said photogenerating layer contains a hydroxygallium phthalocyanine.

* * * * *